US006216778B1

(12) United States Patent
Corwin et al.

(10) Patent No.: US 6,216,778 B1
(45) Date of Patent: Apr. 17, 2001

(54) COOLING SYSTEM FOR AN OFF-HIGHWAY VEHICLE

(75) Inventors: Russell V. Corwin, Derby; Edward L. Wagner, Wichita, both of KS (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/223,705

(22) Filed: Dec. 30, 1998

(51) Int. Cl.[7] ..... F01P 11/08; B60K 11/04; B60K 11/06

(52) U.S. Cl. ..... 165/299; 165/41; 165/51; 165/122; 165/140; 165/916; 123/41.49; 123/41.64; 123/41.12; 123/41.31; 123/196 AB

(58) Field of Search ..... 123/41.49, 41.64, 123/41.12, 41.31, 196 AB; 165/122, 299, 51, 140, 916; 180/68.4

(56) References Cited

U.S. PATENT DOCUMENTS

| | | | | |
|---|---|---|---|---|
| 3,866,580 | * | 2/1975 | Whitehurst | 123/41.64 |
| 3,921,603 | | 11/1975 | Bentz et al. | 123/41.33 |
| 4,011,849 | * | 3/1977 | Latham | 165/51 |
| 4,086,976 | * | 5/1978 | Holm et al. | 123/41.49 |
| 4,133,547 | * | 1/1979 | Fox | 123/41.64 |
| 4,372,409 | * | 2/1983 | Mazu | 123/41.49 |
| 4,377,203 | | 3/1983 | Ejima | 165/125 |
| 4,461,246 | * | 7/1984 | Clemente | 123/41.49 |
| 4,546,742 | * | 10/1985 | Sturges | 123/41.12 |
| 4,815,550 | | 3/1989 | Mather et al. | 180/68.1 |
| 4,872,308 | * | 10/1989 | Nagai et al. | 123/41.64 |
| 4,969,421 | | 11/1990 | Haner et al. | 123/41.49 |
| 5,046,554 | | 9/1991 | Iwasaki et al. | 165/140 |
| 5,219,016 | | 6/1993 | Bolton et al. | 165/41 |
| 5,495,909 | | 3/1996 | Charles | 180/68.1 |
| 5,689,953 | * | 11/1997 | Yamashita et al. | 123/41.49 |
| 5,709,175 | * | 1/1998 | Carroll | 123/41.49 |
| 5,738,167 | * | 4/1998 | Asbjornson et al. | 165/122 |
| 5,839,397 | * | 11/1998 | Funabashi et al. | 123/41.49 |

OTHER PUBLICATIONS

Ashrae Handbook 1983 Equipment vol. pp 3.1–3.11 Ashrae publications, Atlanta, Georgia, 1983.*

* cited by examiner

*Primary Examiner*—John K. Ford
(74) *Attorney, Agent, or Firm*—Jansson, Sharpe, Munger & Stomma, Ltd.

(57) ABSTRACT

A cooling system for an off-highway vehicle includes a heat exchanger (e.g., an engine coolant or hydraulic oil heat exchanger) and a fan mechanism for flowing air along a flow path through the heat exchanger. In the improvement, the fan mechanism is a centrifugal fan mechanism and is substantially the sole means for flowing air along the flow path. That is, there is substantially no ram-urged air. The mechanism includes a housing and a fan in the housing. The fan has forward curved blades, thereby to reduce system noise. A preferred fan has a depth-to-diameter ratio not in excess of about 0.4 and, most preferably, not in excess of about 0.25. An alternate embodiment includes what might be termed a split-discharge arrangement wherein air blown by the fan is discharged along two paths.

14 Claims, 10 Drawing Sheets

COOLING SYSTEM FOR AN OFF-HIGHWAY VEHICLE

FILED OF THE INVENTION

This invention relates generally to motor vehicles and, more particularly, to such vehicles having means to guide and control air for power plant cooling.

BACKGROUND OF THE INVENTION

Liquid-cooled internal combustion engines used to power motorized land vehicles, e.g., passenger autos, construction machines and the like, use an engine block of the type having a multi-passage cooling "jacket." Coolant, usually a mix of water and ethylene glycol, is pumped through the jacket passages and absorbs heat resulting from engine operation. The heated coolant is delivered to a heat exchanger (often referred to as a "radiator") where it is cooled as it gives up heat to the atmosphere. Such coolant is then recirculated back to the cooling jacket.

To function most efficiently and effectively, it is required that air flow across the heat exchanger at a relatively high volumetric rate. While passenger autos are equipped with radiator fans, it is not unusual to automatically disable the fan at highway speeds; the ram-urged air through the heat exchanger is sufficient to remove heat from the coolant. And it is also noteworthy that engine rotational speed and vehicle speed over-the-road are roughly proportional to one another; a slower-running vehicle usually requires less engine cooling. Exemplary cooling systems for over-the-road vehicles are disclosed in U.S. Pat. Nos. 4,969,421 (Haner et al.); 5,046,554 (Iwasaki et al.) and 5,495,909 (Charles).

On the other hand, cooling the engine of an off-highway vehicle presents a different set of technical problems. There are at least three reasons why this is true. One is that even if the heat exchanger is mounted at the front of the vehicle, there is little ram-urged air available to remove heat from the coolant flowing through the heat exchanger—most off-highway vehicles are stationary or move at low ground speed when working. Therefore, some sort of air-moving apparatus must be relied upon to provide a sufficient volumetric flow rate of cooling air.

Another is that when working, the engine is often set to run continuously at full throttle to make available high engine horsepower. It is not unusual to run the engine of an off-highway at 2300–2700 rpm. Implement and vehicle speeds are controlled by, e.g., hydraulic valves and torque-converter-type automatic transmissions. When running at high speed, engines and cooling fans of the types commonly used in off-highway vehicles produce a good deal of noise. While quieter fans with forwardly-turned blades are known, they have not been used on off-highway vehicles, insofar as is known.

Yet another reason relates to the first. Often, the engine is mounted at the rear of the vehicle behind the operator and forward vehicle motion results in no ram-urged cooling air whatsoever.

Exemplary cooling systems for off-highway vehicles are disclosed in U.S. Pat. Nos. 3,921,603 (Bentz et al.); 4,377,203 (Ejima) and 4,815,550 (Mather et al.). The system disclosed in the Mather et al. patent seemingly presents some problems. One is that such system uses, in one embodiment, a double-bladed fan and in any event, uses two opposed inlets. Any openings in the housing around a fan provide a path for fan noise to escape and be heard by the operator and bystanders.

Another is that the double-outlet exhaust is directed to either side of the vehicle. This could present a modest hazard for persons passing near the vehicle while it is in operation.

An improved off-highway-vehicle cooling system which addresses some of the problems and shortcomings of earlier work in this field would be an important technological advance.

OBJECTS OF THE INVENTION

It is an object of the invention to provide an off-highway-vehicle cooling system which addresses some of the problems and shortcomings of the prior art.

Another object of the invention is to provide such a cooling system which helps reduce system noise.

Another object of the invention is to provide such a cooling system which, in a specific embodiment, helps draw exhaust gas through the engine muffler, thereby reducing muffler back pressure.

Yet another object of the invention is to provide such a cooling system which, in a particular embodiment, helps cool the engine compartment.

Another object of the invention is to provide such a cooling system which, in yet other embodiments, provide thermostatic control of fan speed to help reduce system noise. How these and other objects are accomplished will become apparent from the following descriptions and from the drawings.

SUMMARY OF THE INVENTION

An off-highway-vehicle cooling system includes a heat exchanger for removing heat from, e.g., the engine coolant, hydraulic oil, automatic transmission fluid or the like. A fan mechanism flows air along a flow path through the heat exchanger. In the improvement, the fan mechanism is a centrifugal fan mechanism and includes a scroll-shaped housing and a fan in the housing. The fan has forward curved blades, thereby to reduce system noise. Such fan is preferred in the invention even though its efficiency is less than the efficiencies of fans with radial tips or backward curved blades. And such fan is preferred (for reasons relating to sound reduction) even though it requires about twice as much torque as other fan types to provide a given volumetric flow rate.

In other aspects of the invention, the fan rotates in a plane and has an upstream portion (i.e., upstream of the plane) toward the flow path and a downstream portion away from the flow path. The fan is in a housing having a shroud covering the downstream portion. Because most off-highway vehicles are stationary or move at very low ground speed when working, there is little if any ram-urged air contributing to cooling. In other words, the fan mechanism is substantially the sole means for flowing air along the flow path.

The housing includes a single inlet port which is adjacent to the upstream portion of the fan. In a specific embodiment, the inlet port is circular and concentric with the fan axis of rotation. The housing also includes a discharge portion from which heat-entraining air is discharged from the cooling system.

In other aspects of the invention, the fan has a diameter and an axially-measured depth, i.e., a "thickness" measured parallel to the axis of rotation. The ratio of the depth to the diameter is not in excess of about 0.4 and, most preferably, is not in excess of about 0.25.

In particular embodiments, the new cooling system has yet other features which reduce system noise. The engine heat exchanger has engine coolant flowing through it and the fan is powered by a hydraulic motor having a thermostatic controller coupled in speed-controlling relationship to such motor. The thermostatic controller controls the speed of the hydraulic motor as a function of the temperature of the engine coolant.

Assuming that the vehicle is equipped with some sort of hydraulic system, the cooling system may also include a second heat exchanger for removing heat from hydraulic oil. The thermostatic controller controls the speed of the hydraulic motor as a function of the temperature of the hydraulic oil. And such thermostatic controller may be arranged to control hydraulic motor speed as a function of either the hydraulic oil or the engine coolant, depending upon which liquid is exceeding a temperature limit.

And that is not all. The new cooling system has yet other beneficial features. In an off-highway vehicle, the cooling system is mounted adjacent to an engine compartment having the engine within it. The cooling-air flow path has an entry opening at the rear of such vehicle and is substantially free of ram-urged air. The fan mechanism preferably urges fan discharge air upwardly away from the vehicle.

In a particular embodiment, the fan housing has an upwardly pointing discharge mouth and the vehicle includes an air receiving structure, sometimes referred to as a diffuser, in air flow communication with such discharge mouth and vented to ambient air. The housing and the receiving structure are spaced apart somewhat and define a venturi aperture between them. Such aperture is in air flow communication with the engine compartment and draws cooling air through such compartment and across the engine. (In the exemplary skid-steer vehicle described below, the operator sits very close to the engine. Cooling air is drawn through the operator's compartment, through small openings in the otherwise-totally-enclosed engine compartment and across the engine.)

In yet another specific embodiment, the above-described venturi aperture is referred to as a first venturi aperture. The engine has a muffler and muffler pipe connected to it for flowing exhaust gas from the engine exhaust manifold. The air receiving structure has an exhaust stack connected to it and the exhaust stack and the muffler pipe are spaced from one another, thereby defining a second venturi aperture, Air from the discharge mouth of the fan housing flows through the second venturi aperture and along the exhaust stack, thereby drawing exhaust gas through the muffler pipe. This helps reduce muffler back pressure, aiding engine aspiration and exhaust.

In yet another embodiment of the new cooling system, the fan mechanism has a single inlet port but has first and second discharge portions in downstream flow relationship to the fan. Such first and second portions direct air along first and second discharge paths which are angled with respect to one another. That is, the discharge paths are coincident with respective fan radii which define an angle between them. The fan has first and second spaced-apart rims and the fan housing has a mid-plate positioned intermediate the rims. A first scroll component of the housing is around the first rim, is attached to the mid-plate and defines the first discharge path. Similarly, the housing has a second scroll component around the second rim. Such second component is attached to the mid-plate and defines the second discharge path.

As with the fan mechanism having a single discharge portion, the corresponding mechanism with two discharge portions is substantially free of ram-urged air. Preferably, the fan used in such mechanism has a ratio of fan depth to fan diameter is not in excess of about 0.4 and, most preferably, not in excess of about 0.25. And as with the single-discharge-portion fan mechanism, the fan may be powered by a hydraulic motor, the speed of which is controlled as a function of the temperature of the engine coolant, as a function of the temperature of the hydraulic oil or as a function of both.

Further details of the invention are set forth in the following detailed descriptions and in the drawings.

DETAILED DESCRIPTIONS OF PREFERRED EMBODIMENTS

Figure 1:
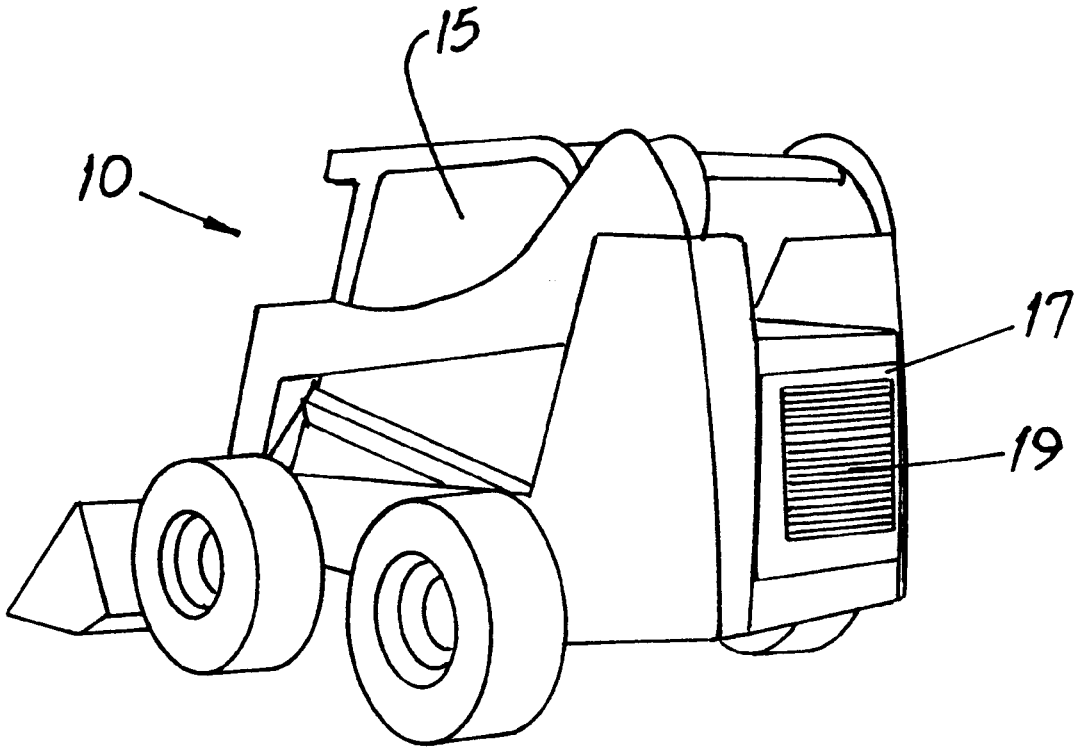
FIG. 1 is a representative perspective view of an exemplary skid-steer front end loader equipped with the new cooling system
Figure 2:
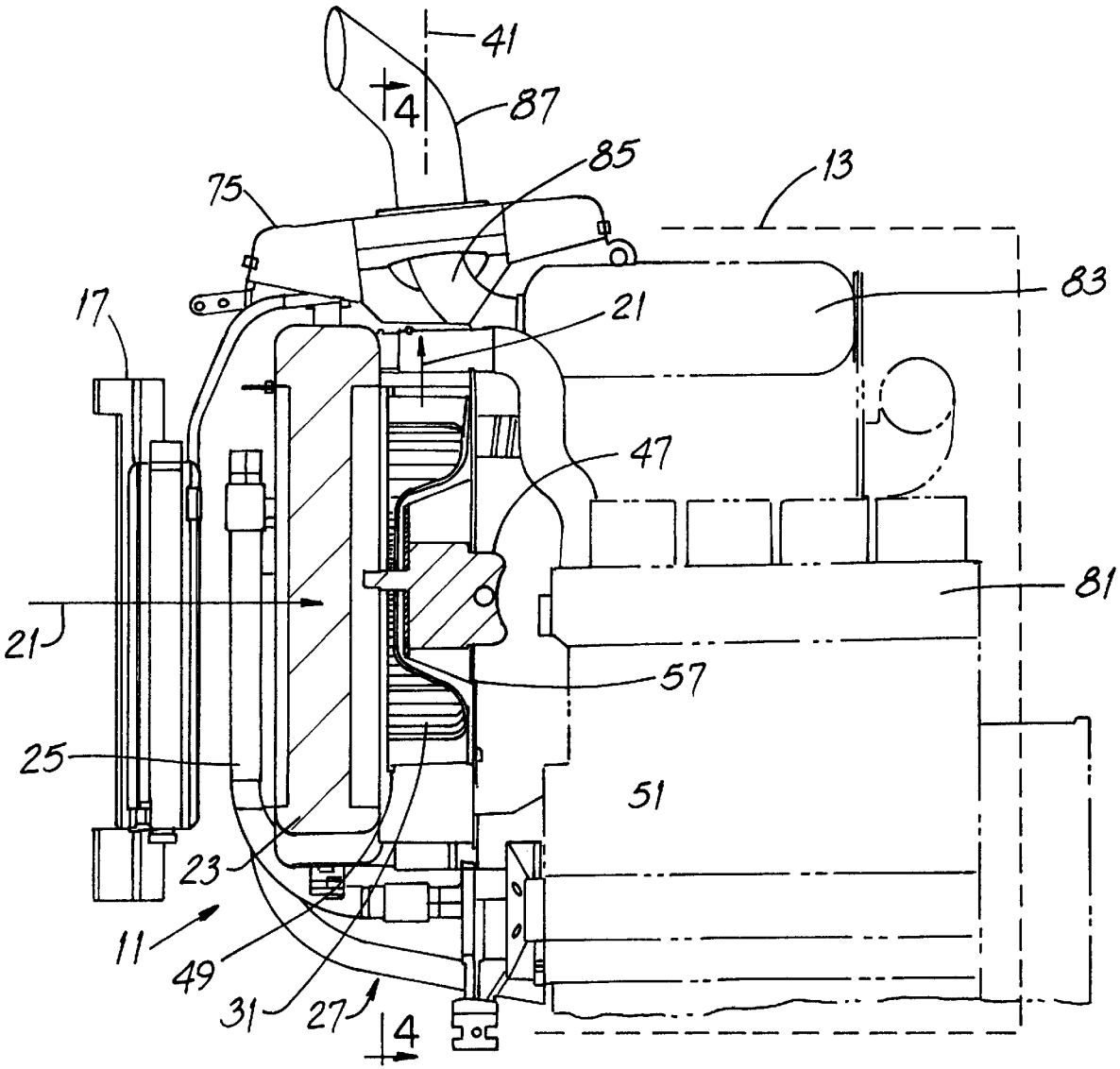
FIG. 2 is a sectional elevation view of the new cooling system shown in conjunction with a vehicle engine.
Figure 3:
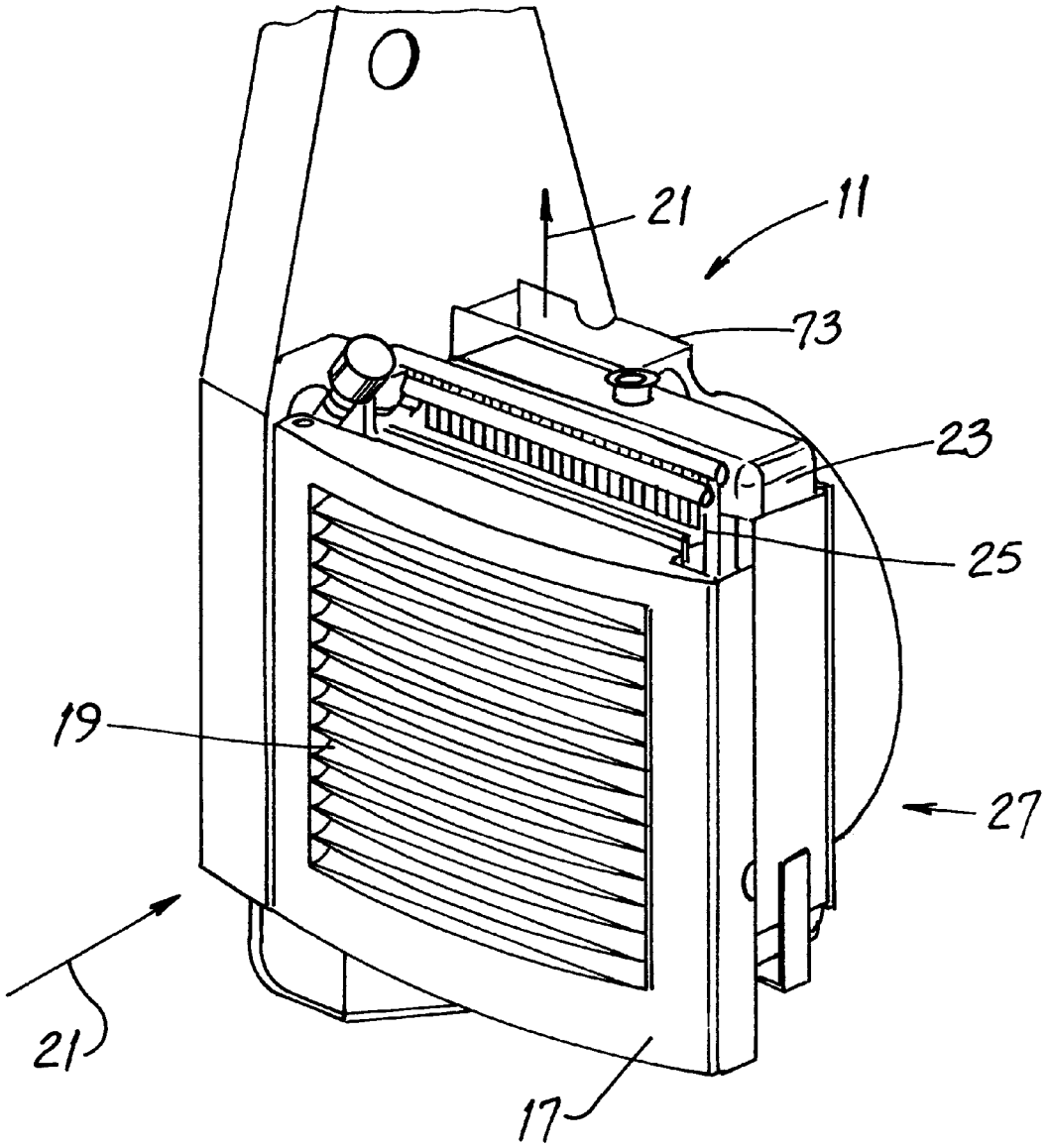
FIG. 3 is a perspective view of the new cooling system shown in conjunction with components of the vehicle. Parts are broken away.
Figure 4:
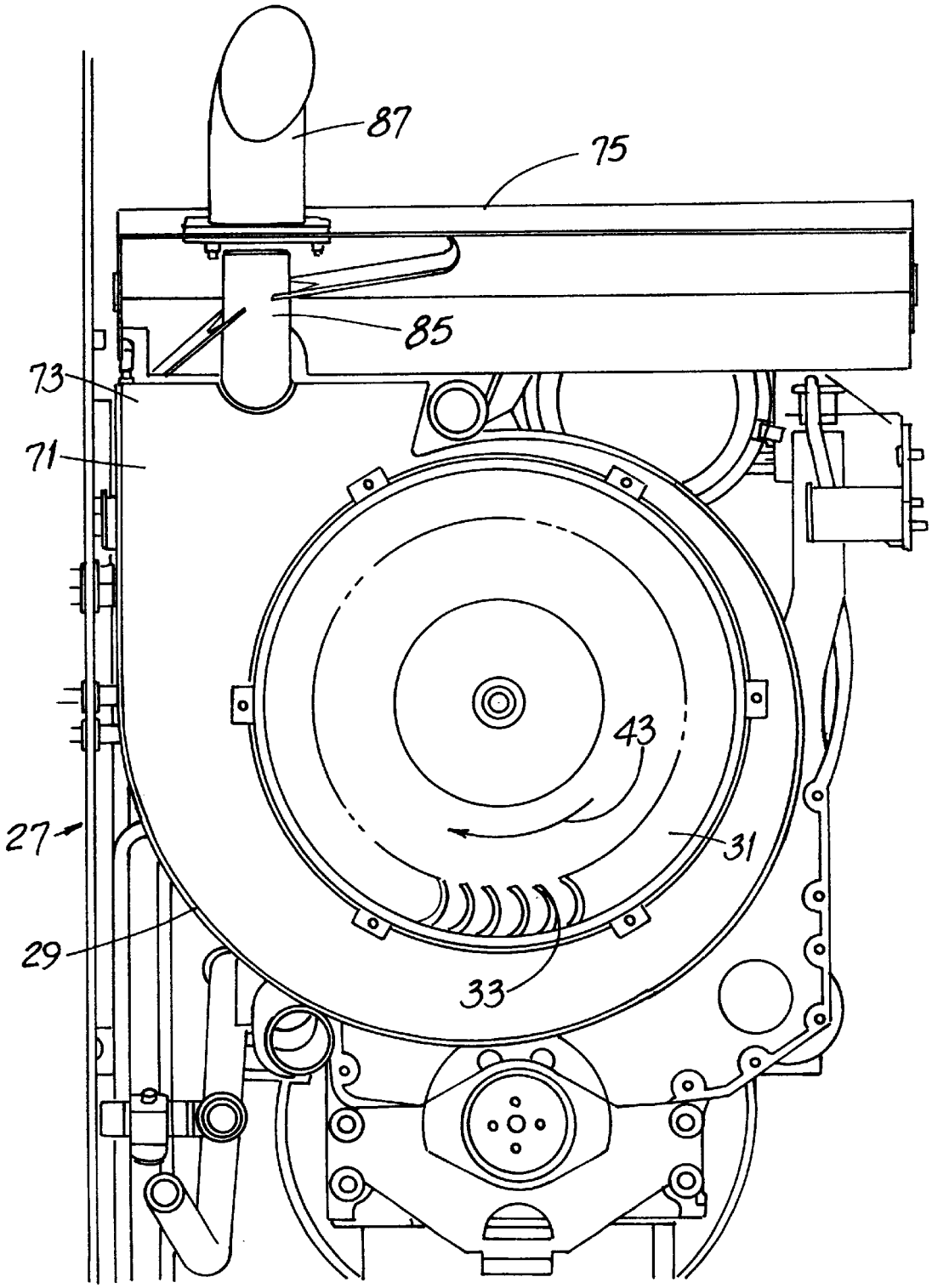
FIG. 4 is a section view of the cooling system taken along the viewing plane 4—4 of FIG. 2. Parts are broken away.
Figure 5:
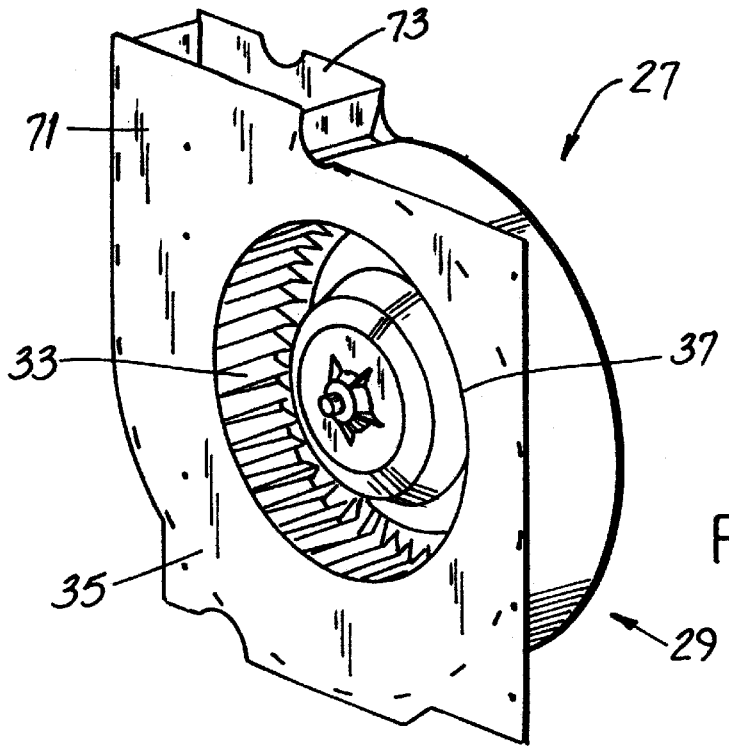
FIG. 5 is a perspective view of the fan mechanism used in the cooling system.
Figure 6:
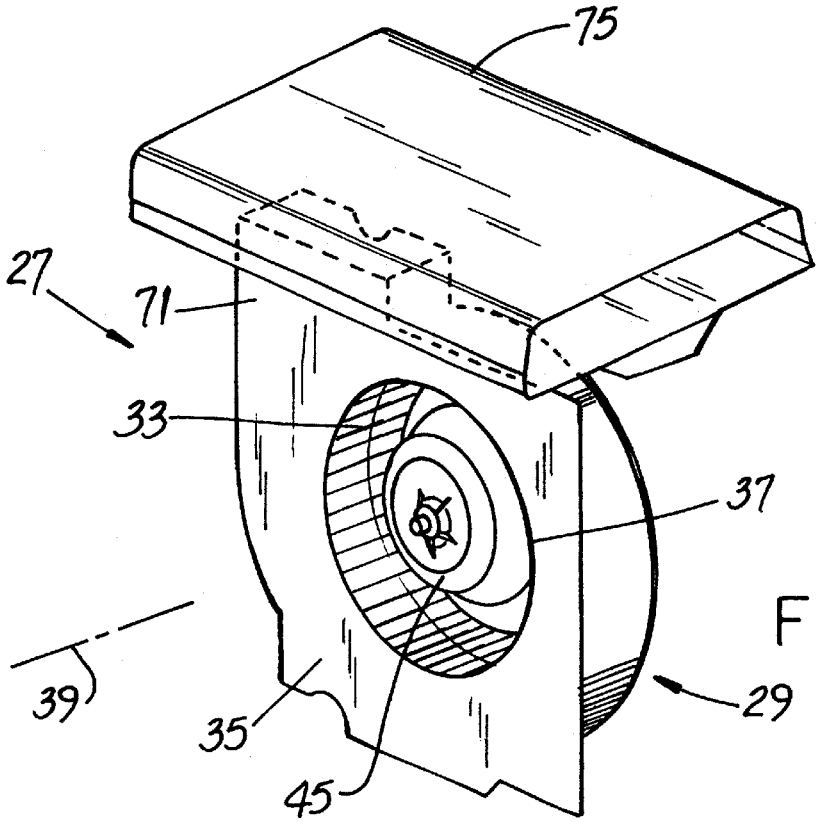
FIG. 6 is a perspective view of the fan mechanism of FIG. 5 shown in conjunction with an air receiving structure, i.e., a diffuser. Surfaces of parts are shown in dashed outline.

Referring first to FIGS. 1, 2 and 3, an exemplary off-highway vehicle 10 is equipped with the new cooling system 11. Such vehicle 10 is of a type known as a skid-steer front end loader. The vehicle 10 includes an engine compartment, represented by the dashed-line box 13, adjacent to the operator's compartment 15. A rear door 17 has slots 19 therethrough and such slots 19 are in air flow communication with the cooling system 11 described below. That is, the cooling air flow path 21, represented by the same-numbered arrow in FIGS. 2 and 3, is in a forward direction through the door 17. Because most off-highway vehicles (like the vehicle 10) are stationary or move at low ground speed when working, there is little or no ram-urged air in the flow path 21.

(The term "skid-steer" refers to the fact that all of the vehicle wheels are maintained perpendicular to their respective axles. Steering is effected by driving the wheels on one side of the vehicle 10 at a rotational speed which is different than that at which the wheels on the other side of the vehicle 10 are driven. The vehicle 10 may thereby be steered but the wheels skid somewhat in the process.)

Referring additionally to FIGS. 4, 5, 6 and 7, the cooling system 11 includes a first heat exchanger 23 for removing heat from the engine coolant flowing through it. There is also a second, hydraulic oil heat exchanger 25 which has hot hydraulic oil flowing therethrough and the air moving across such heat exchanger 25 removes heat from such oil. The fan mechanism 27 draws air in through the rear door 17 and flows such air along the flow path 21 through the heat exchangers 25 and 23, in that order from upstream to downstream. The fan mechanism 27 is closely adjacent to the heat exchanger 23 and includes a scroll-shaped housing 29 in which is positioned a fan 31 having forward curved blades 33. The housing 29 has an intake plate 35 with the air inlet port 37 through it and in a specific embodiment, the port 37 is circular and concentric with the rotational axis 39 of the fan 31. The fan 31 rotates in a plane 41 and the direction of fan rotation is indicated by the arrow 43.

Figure 7:
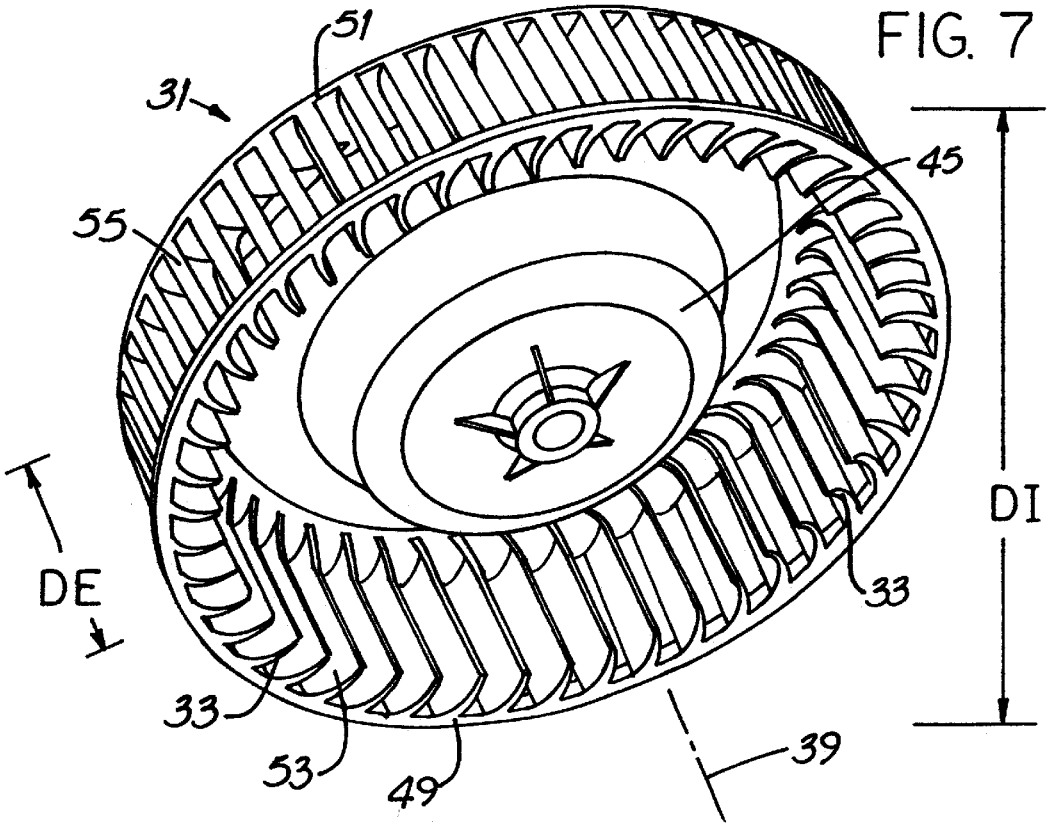
FIG. 7 is a perspective view of the fan used in the cooling system.

Referring particularly to FIG. 7, the fan 31 has a diameter DI and an axially-measured depth DE (i.e., a "thickness"), measured perpendicular to and parallel to the axis of rotation 39, respectively. The ratio of the depth DE to the diameter DI is not in excess of about 0.4 and, most preferably, is not in excess of about 0.25. In addition, the fan 31 has a dished hub 45 convex in an upstream direction. As a consequence, the hydraulic motor 47 used to drive the fan 31 is, as shown in FIG. 2, partially "nested" in the hub 45, thereby reducing the overall length of the system 11.

The fan 31 has first and second spaced-apart rims 49 and 51, respectively with the rim 49 being at the upstream portion 53 of the fan 31, i.e., upstream of the plane 41 and toward the flow path 21. The rim 51 is at the fan downstream portion 55 which may be said to be away from the flow path 21. A housing shroud 57 covers the downstream portion 55 so that the fan mechanism 27 has but a single inlet, namely, the inlet port 37 described above. As shown in FIG. 2, the hydraulic motor 47 protrudes through a hole in the shroud 57 but since the shroud 57 and motor 47 are closely fitted to one another, any small interstice between the motor 47 and shroud 57 is ineffective as an inlet port.

Figure 8:
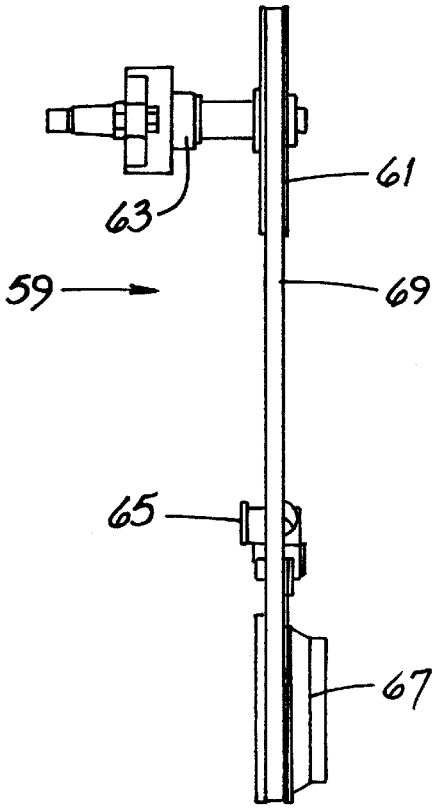
FIG. 8 is an elevation view of a belt drive mechanism.

(While driving the fan 31 with a hydraulic motor 47 is preferred, it should be understood that the fan 31 may be driven by a belt drive mechanism 59 like that shown in FIG. 8. Such mechanism 59 includes a fan pulley 61, a pulley support mechanism 63, a belt tensioning mechanism 65 and an engine crankshaft pulley 67. A V-belt 69 takes power from the pulley 67 and drives the pulley 61.)

Figure 9:
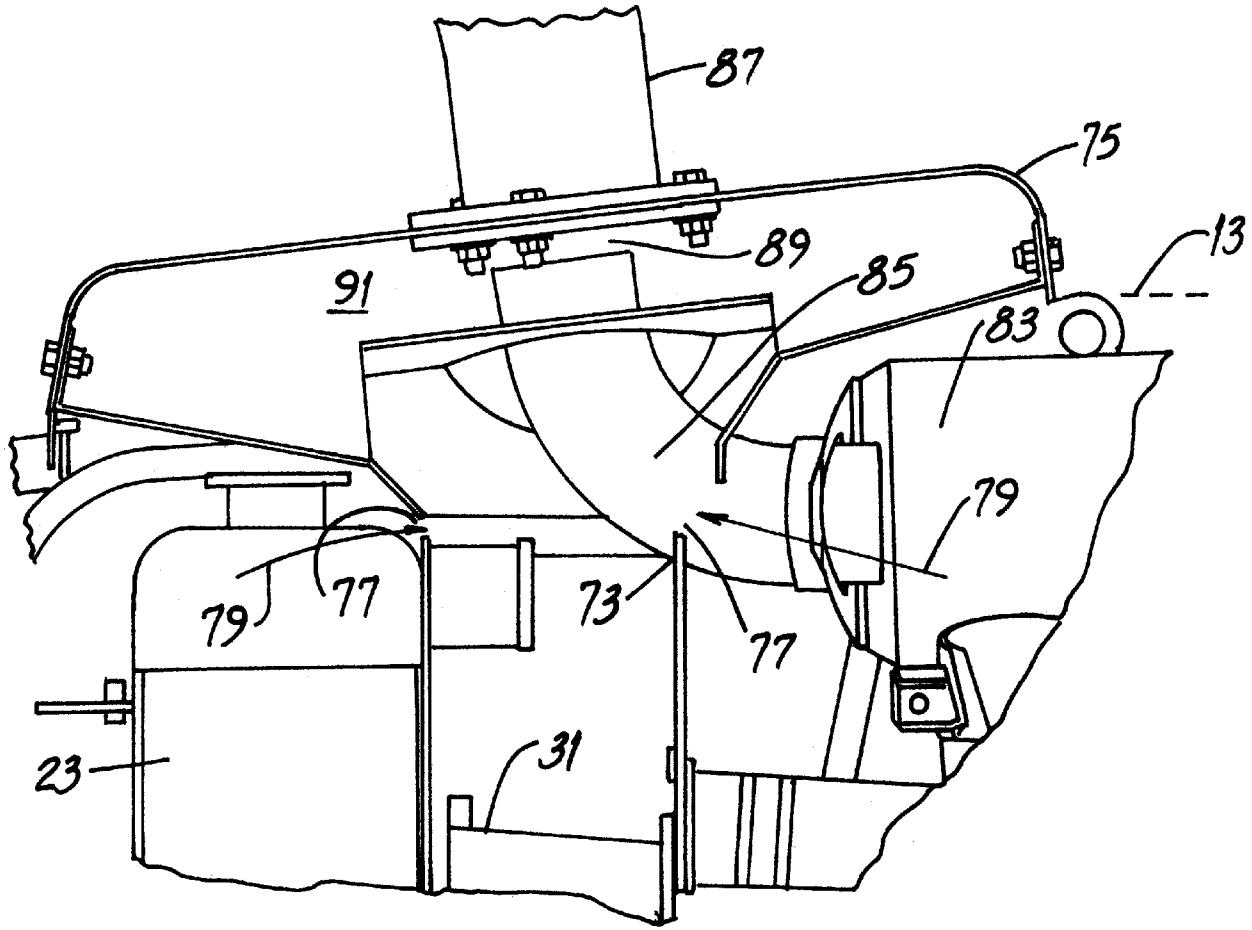
FIG. 9 is a section view of portions of the cooling system shown in conjunction with engine components. Parts are broken away.

Referring also to FIG. 9, the housing 29 also includes an upwardly directed discharge portion 71 terminated in a mouth 73 from which heat-entraining air is discharged from the cooling system 11 in a direction away from the vehicle 10. An air receiving structure 75, sometimes referred to as a diffuser, is mounted above and in air flow communication with such discharge mouth 73. The structure 75 vents to ambient air. The mouth 73 and the receiving structure 75 are spaced apart somewhat and define a first venturi aperture 77 between them. Such aperture 77 is in air flow communication with the engine compartment 13 and as represented by the arrows 79, the system 11 thereby draws cooling air through such compartment 13 and across the engine 81.

The engine has a muffler 83 and muffler pipe 85 connected to it for flowing exhaust gas from the engine exhaust manifold. The air receiving structure 75 has an exhaust stack 87 connected to it and the exhaust stack 87 and the muffler pipe 85 are spaced from one another. Such stack-pipe spacing defines a second venturi aperture 89. Air from the discharge mouth 73 of the fan housing 29 flows through the second venturi aperture 89 and along the exhaust stack 87, thereby slightly reducing the pressure in the region 91. As a result, exhaust gas is better able to flow from the muffler pipe 85. To state it in other words, the foregoing configuration helps reduce muffler back pressure, aiding engine aspiration and exhaust.

Figure 10:
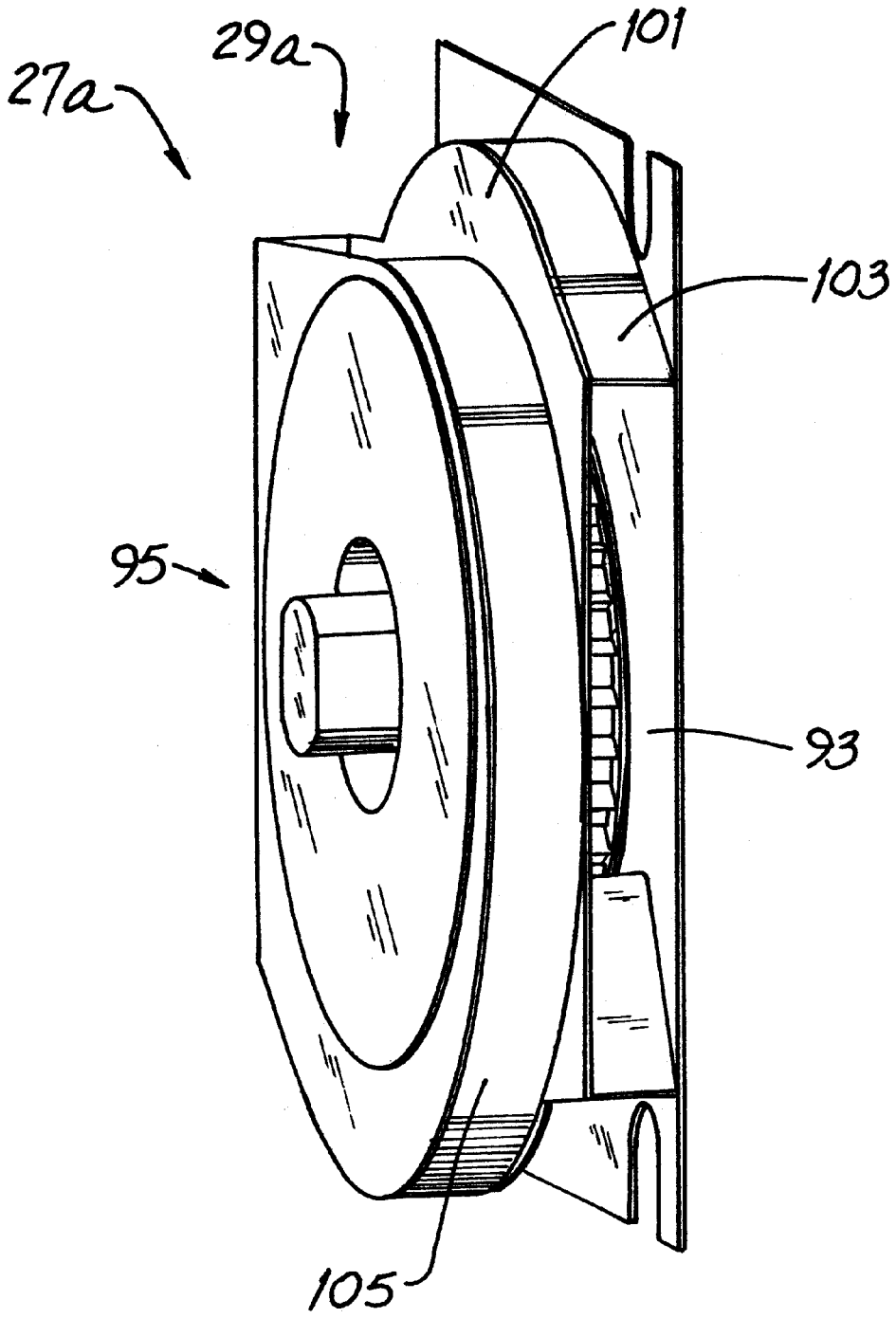
FIG. 10 is a perspective view of an alternate embodiment of a fan mechanism.
Figure 11:
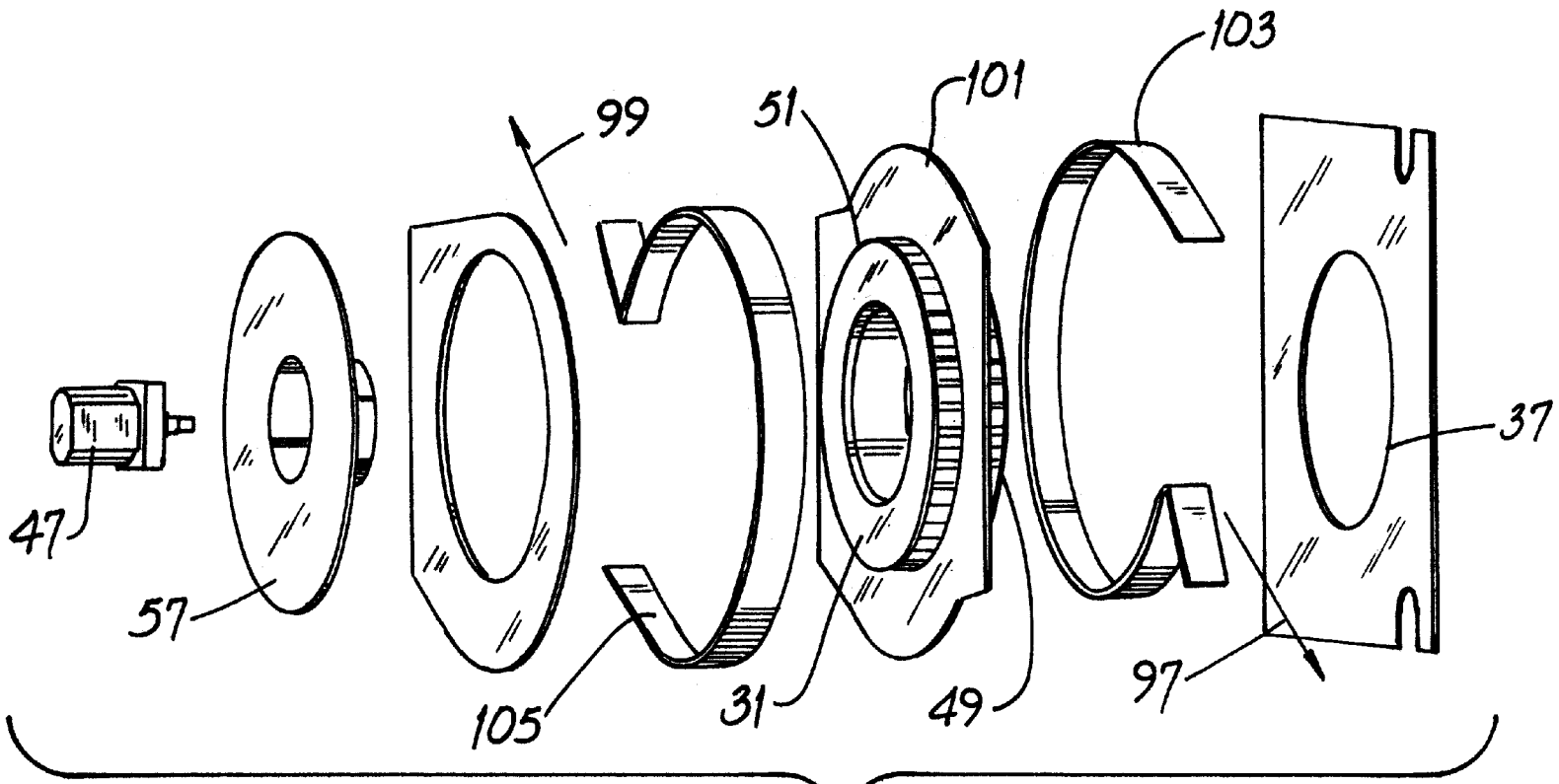
FIG. 11 is an exploded view of the fan mechanism of FIG. 10.

Referring now to FIGS. 10 and 11, another embodiment of the new cooling system 11 has a fan mechanism **27*a* with the single inlet port 37 but with first and second discharge portions 93, 95, respectively, in downstream flow relationship to the fan 31. Such first and second portions 93, 95 direct air along first and second discharge paths 97, 99**, respectively, which are angled with respect to one another.

In this "two-discharge-path" configuration, the fan housing **29*a* has a mid-plate 101 positioned between the rims 49, 51. A first scroll component 103 of the housing 29*a* is around the first rim 49, is attached to the mid-plate 101 and defines the first discharge path 97. Similarly, the housing 29*a* has a second scroll component 105 around the second rim 51. Such second component 105 also is attached to the mid-plate 101 and defines the second discharge path 99**.

As with the fan mechanism 27 having a single discharge portion 71, the corresponding mechanism **27*a* with two discharge portions 93, 95 is substantially free of ram-urged air. Preferably, the fan 31 used in such mechanism 27*a*** has a ratio of fan depth DE to fan diameter DI as described above and is otherwise configured as described above.

Figure 12:
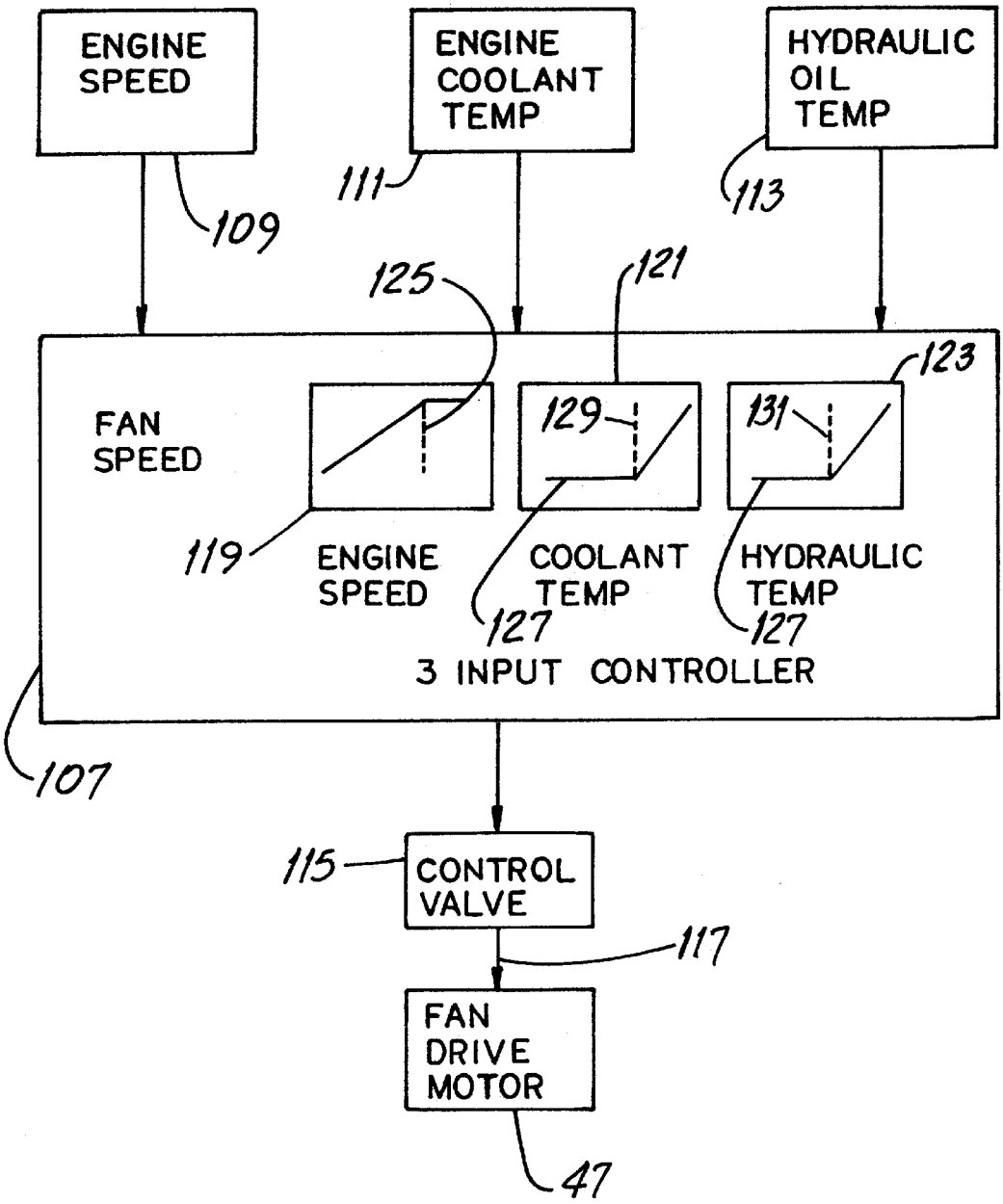
FIG. 12 is a diagrammatic representation of a fan speed control arrangement.

The new cooling system 11 (whether having one discharge portion 71 or two such portions 93, 95) may be configured with yet other features which reduce system noise. Referring also to FIG. 12, a thermostatic fan speed controller 107 has one, two or three input signals to it. Such signals include engine speed, represented by the symbol 109, engine coolant temperature, represented by the symbol 111, and hydraulic oil temperature represented by the symbol 113. The controller 107 is coupled to a hydraulic valve 115 which responds to an output signal from the controller 107 along the line 117. The valve 115 controls the speed of the fan drive motor 47.

The graphs 119, 121, 123 represent, respectively, fan speed plotted as a function of engine speed, of engine coolant temperature and as a function of hydraulic oil temperature. The controller 107 may be configured to control the speed of the hydraulic motor 47 as a function of engine speed, as a function of the temperature of the engine coolant and/or as a function of the temperature of the hydraulic oil. As an example represented by the graph 119, the controller 107 may be configured to increase fan speed generally in proportion to increasing engine speed until some predetermined engine speed is reached (represented by the line 125), at which fan speed is held constant with further increases in engine speed.

As other examples, fan speed may be held at a low level (represented by the straight lines 127) until a predetermined engine coolant temperature or a predetermined hydraulic oil temperature is reached, as represented by the lines 129, 131, respectively. Thereupon, fan speed is increased generally proportionally to further increases in engine coolant or hydraulic oil temperature. And the temperatures of both liquids can be monitored with that temperature which would result in a higher fan speed being used as the "priority" signal for the controller 107.

Remarkably, it has been found that the new cooling system 11 effects a noise reduction of on the order of 15 db as compared to some conventional systems. The new system 11 is suited for a wide variety of applications including but not limited to applications in off-highway vehicles, e.g., construction equipment, and in agricultural machines, e.g., combines, tractors and the like.

As used herein, the phrase "off-highway-vehicle" includes vehicles configured for primary use on terrain other than roads. Off-highway-vehicles include skid-steer loaders, trenchers, loader backhoes, wheel loaders, crawler tractors, agricultural tractors and combines, as examples. The phrase "off-highway-vehicle" excludes passenger vehicles and the like which are configured primarily for use on hard-surface and, occasionally, gravel roads.

As used herein, the phrase "ram-urged air" means air urged, by virtue of the velocity of the vehicle over the ground, into the flow path of air used for cooling engine coolant and/or hydraulic oil. As an example, passenger vehicles and the like rely in large part upon ram-urged air for removing heat from the engine coolant heat exchanger, commonly known as the radiator.

While the principles of the invention have been shown and described in connection with preferred embodiments, it is to be understood clearly that such embodiments are by way of example and are not limiting.

What is claimed:

1. In a off-highway-vehicle cooling system including a heat exchanger; a fan mechanism for flowing air along a flow path through the heat exchanger; and an air receiving structure vented to ambient air; the improvement wherein:

the fan mechanism is a centrifugal fan mechanism and includes a housing and a fan in the housing;

the fan has forward curved blades, thereby to reduce system noise;

the system is mounted adjacent to an engine compartment containing an engine;

the housing includes a discharge mouth in air flow communication with the receiving structure;

the housing and the receiving structure define a first venturi aperture therebetween;

the first venturi aperture is in air flow communication with the engine compartment, thereby drawing cooling air through such compartment and across the engine;

the engine has a muffler pipe connected thereto for flowing exhaust gas from the engine;

the receiving structure has an exhaust stack connected thereto;

the exhaust stack and muffler pipe are spaced from one another and define a second venturi aperture therebetween; and air from the discharge mouth flows through the second venturi aperture and along the exhaust stack, thereby drawing exhaust gas through the muffler pipe.

2. The system of claim 1 wherein:

the fan has an upstream portion toward the flow path and a downstream portion away from the flow path;

the housing includes a shroud covering the downstream portion; and the fan mechanism is substantially the sole means for flowing air along the flow path.

3. The system of claim 2 wherein:

the housing includes a single inlet port; and the inlet port is adjacent to the upstream portion.

4. The system of claim 3 wherein:

the fan has a diameter and an axially-measured depth; and the ratio of the depth to the diameter is not in excess of about 0.4.

5. The system of claim 1 wherein:

the heat exchanger has engine coolant flowing therethrough;

the fan is powered by a hydraulic motor having a thermostatic controller coupled in speed-controlling relationship thereto; and the thermostatic controller controls the speed of the hydraulic motor as a function of the temperature of the engine coolant.

6. The system of claim 1 wherein:

the heat exchanger is a first heat exchanger for removing heat from engine coolant;

the cooling system includes a second heat exchanger for removing heat from hydraulic oil;

the fan is powered by a hydraulic motor having a thermostatic controller coupled in speed-controlling relationship thereto; and the thermostatic controller controls the speed of the hydraulic motor as a function of the temperature of the hydraulic oil.

7. The system of claim 1 in combination with an off-highway vehicle and wherein:

the flow path has an entry opening at the rear of the vehicle;

the fan mechanism urges the air upwardly away from the vehicle; and the flow path is substantially free of ram-urged air.

8. In a cooling system for an off-highway vehicle and including a heat exchanger, a fan mechanism for flowing air along a flow path through the heat exchanger; and an air receiving structure vented to ambient air, the improvement wherein:

the fan mechanism includes a centrifugal fan, a single inlet port in upstream flow relationship to the fan and a first discharge portion in downstream flow relationship to the fan;

the fan has forward curved blades, thereby to reduce system noise;

the system is mounted adjacent to an engine compartment containing an engine;

the discharge portion is in air flow communication with the receiving structure;

the discharge portion and the receiving structure define a first venturi aperture therebetween;

the first venturi aperture is in air flow communication with the engine compartment, thereby cooling air through such compartment and across the engine;

the engine has a muffler pipe connected thereto for flowing exhaust gas from the engine;

the receiving structure has an exhaust stack connected thereto;

the exhaust stack and muffler pipe are spaced from one another and define a second venturi aperture therebetween; and air from the discharge portion flows through the second venturi aperture and along the exhaust stack, thereby drawing exhaust gas through the muffler pipe.

9. The cooling system of claim 8 wherein the flow path is substantially free of ram-urged air.

10. The cooling system of claim 9 wherein:

the fan has a diameter and an axially-measured depth; and the ratio of the depth to the diameter is not in excess of about 0.4.

11. The cooling system of claim 10 wherein the ratio of the depth to the diameter is not in excess of about 0.25.

12. The cooling system of claim 8 wherein:

the heat exchanger has engine coolant flowing therethrough;

the fan is powered by a hydraulic motor having a thermostatic controller coupled in speed-controlling relationship thereto; and the thermostatic controller controls the speed of the hydraulic motor as a function of the temperature of the engine coolant.

13. The cooling system of claim 8 wherein:

the heat exchanger is a first heat exchanger for removing heat from engine coolant;

the cooling system includes a second heat exchanger for removing heat from hydraulic oil;

the fan is powered by a hydraulic motor having a thermostatic controller coupled in speed-controlling relationship thereto; and the thermostatic controller controls the speed of the hydraulic motor as a function of the temperature of the hydraulic oil.

14. The cooling system of claim 11 wherein:

the heat exchanger is a first heat exchanger for removing heat from engine coolant;

the cooling system includes a second heat exchanger for removing heat from hydraulic oil;

the fan is powered by a hydraulic motor having a thermostatic controller coupled in speed-controlling relationship thereto; and the thermostatic controller controls the speed of the hydraulic motor as a function of the temperature of the hydraulic oil.

* * * * *